US012520943B2

(12) United States Patent
Zhang et al.

(10) Patent No.: US 12,520,943 B2
(45) Date of Patent: Jan. 13, 2026

(54) QUICK-ASSEMBLY STRUCTURE FOR CHASSIS AND BACK FRAME OF CHAIR AND CHAIR

(71) Applicant: SUNON TECHNOLOGY CO.,LTD, Zhejiang (CN)

(72) Inventors: Xujun Zhang, Zhejiang (CN); Hao Wu, Zhejiang (CN); Changjiang Liu, Zhejiang (CN); Xianping He, Zhejiang (CN); Aijun Qian, Zhejiang (CN); Haibo Lu, Zhejiang (CN)

(73) Assignee: SUNON TECHNOLOGY CO., LTD, Zhejiang (CN)

( * ) Notice: Subject to any disclaimer, the term of this patent is extended or adjusted under 35 U.S.C. 154(b) by 288 days.

(21) Appl. No.: 18/451,114

(22) Filed: Aug. 17, 2023

(65) Prior Publication Data

US 2024/0099465 A1 Mar. 28, 2024

(30) Foreign Application Priority Data

Sep. 28, 2022 (CN) ..... 202222575706.3

(51) Int. Cl.
*A47C 7/00* (2006.01)
*A47C 4/02* (2006.01)
*A47C 7/42* (2006.01)

(52) U.S. Cl.
CPC ..... *A47C 4/02* (2013.01); *A47C 7/004* (2013.01); *A47C 7/42* (2013.01)

(58) Field of Classification Search
CPC ..... A47C 7/004; A47C 7/42
See application file for complete search history.

(56) References Cited

U.S. PATENT DOCUMENTS

| | | | | |
|---|---|---|---|---|
| 6,619,745 | B2 * | 9/2003 | Roberts | A47C 7/42 297/383 |
| 10,357,110 | B2 * | 7/2019 | Potrykus | A47C 1/032 |
| 11,213,132 | B1 * | 1/2022 | Wu | A47C 7/42 |
| 11,672,347 | B1 * | 6/2023 | Wu | A47C 7/42 297/440.15 |
| 11,898,584 | B2 * | 2/2024 | Slach | F16B 12/2009 |

(Continued)

FOREIGN PATENT DOCUMENTS

| | | | | |
|---|---|---|---|---|
| CN | 114431658 A | * | 5/2022 | A47C 7/004 |
| DE | 10312446 B3 | * | 8/2004 | A47C 7/42 |

(Continued)

*Primary Examiner* — Timothy J Brindley
(74) *Attorney, Agent, or Firm* — JCIPRNET

(57) ABSTRACT

A quick-assembly structure includes an inserting portion and an inserting port allowing the inserting portion to be inserted, where one of the inserting portion and the inserting port is provided on the chassis, and the other one is provided on the back frame. A locking block of the inserting portion is movably arranged relative to the inserting port; and in an assembled state, a bump of the inserting portion is inserted into the inserting port along with the inserting portion, the locking block is pushed by an elastic force of an elastic member of the inserting port to enter a locking position, and at the locking position, a locking end of the locking block enters the inserting port and abuts against an abutting surface of the bump so as to restrict the inserting portion from being pulled out in a direction opposite to an inserting direction thereof.

7 Claims, 2 Drawing Sheets

(56) References Cited

U.S. PATENT DOCUMENTS

| | | | | |
|---|---|---|---|---|
| 11,950,709 | B2 * | 4/2024 | Bock | A47C 4/028 |
| 2011/0140498 | A1 * | 6/2011 | Tsai | A47C 1/0307 297/411.38 |
| 2017/0027329 | A1 * | 2/2017 | Su | A47C 1/0307 |
| 2021/0246925 | A1 * | 8/2021 | Slach | A47C 7/42 |

FOREIGN PATENT DOCUMENTS

| | | | | |
|---|---|---|---|---|
| DE | 102021214820 | A1 * | 6/2023 | A47C 7/42 |
| JP | H10272032 | A * | 10/1998 | A47C 7/42 |
| KR | 20230115490 | A * | 8/2023 | A47C 3/24 |

* cited by examiner

QUICK-ASSEMBLY STRUCTURE FOR CHASSIS AND BACK FRAME OF CHAIR AND CHAIR

CROSS-REFERENCE TO RELATED APPLICATION

This application claims the priority benefit of China application serial no. 202222575706.3, filed on Sep. 28, 2022. The entirety of the above-mentioned patent application is hereby incorporated by reference herein and made a part of this specification.

TECHNICAL FIELD

The present disclosure relates to the technical field of chairs, in particular to a quick-assembly structure for a chassis and a back frame of a chair and a chair.

BACKGROUND

With the development of science and technology, people have the increasingly high pursuit for the shapes of chairs. At present, some chairs on the market mainly comprise bases and chair backs, wherein each of the bases comprises a chassis and a seat cushion mounted on the chassis, each of the chair backs comprises a back frame and a back cushion mounted on the back frame, and the back frame is connected to the chassis.

With regard to the existing chairs, in order to facilitate packaging and transportation, the back frames and the chassis are usually connected in such a connection manner that screws fit holes, thereby ensuring the detachable connection of the back frames and the chassis. For the chairs with the back frames and the chassis assembled by means of the screws, although mutual assembly and disassembly can be achieved, in the actual application process, the phenomena of deviations of the holes and slippage of the screws appear easily, so that after users receive the chairs, it is difficult for the users to assemble the back frames and the chassis smoothly. In addition, with the adoption of the screw mounting manner, the assembly process is complex and is not convenient enough, and thus there is room for improvement.

SUMMARY OF THE INVENTION

In order to solve at least one technical problem mentioned in the background, the present disclosure provides a quick-assembly structure for a chassis and a back frame of a chair.

To achieve the above-mentioned purposes, the present disclosure provides the following technical solution:

the quick-assembly structure for a chassis and a back frame of a chair is configured to assemble a chassis and a back frame and comprises an inserting portion and an inserting port allowing the inserting portion to be inserted, wherein one of the inserting portion and the inserting port is provided on the chassis, and the other one is provided on the back frame; the inserting portion is provided with a bump, and the bump comprises an abutting surface; the inserting port is provided with an elastic member and a locking block, the locking block comprises a locking end, and the locking block is movably arranged relative to the inserting port; and in an assembled state, the bump is inserted into the inserting port along with the inserting portion, the locking block is pushed by means of an elastic force of the elastic member to enter a locking position, and at the locking position, the locking end enters the inserting port and abuts against the abutting surface of the bump so as to restrict the inserting portion from being pulled out in a direction opposite to an inserting direction thereof.

Compared with the prior art, the solution has the advantages as follows:

in this solution, the inserting portion and the inserting port are provided, and the bump, the elastic member and the locking block are arranged in a fitting manner, so that when the back frame and the chassis need to be assembled, the inserting portion can be inserted into the inserting port in an extension direction of the inserting port; with the gradual insertion of the inserting portion, the locking end of the locking block may finally abut against the abutting surface of the bump under an elastic force of the elastic member, so that the locking block and the bump are clamped with each other; and under the limiting action of the locking end, the inserting portion and the bump cannot be withdrawn, thereby achieving the assembly of the back frame and the chassis.

It can be seen therefrom that in the solution, the back frame and the chassis are assembled in an inserting fit manner, compared with a traditional manner for assembly with screws fitting holes, the quick-assembly structure has the advantages as follows: firstly, the quick-assembly structure is easier and more convenient to operate; and secondly, the problem that assembly cannot be realized due to slippage of the screws or deviations of the holes can be avoided. In a word, the user experience can be improved.

Preferably, the locking block comprises a bottom end surface, and a front end of the bottom end surface constitutes the locking end; and a rear side surface of the bump constitutes the abutting surface.

Preferably, a movement direction of the locking block is inclined relative to the extension direction of the inserting port, each of the bottom end surface of the inserting portion and the abutting surface of the bump is of a slope structure, and a plane where the bottom end surface is located is perpendicular to a plane where the abutting surface is located.

Preferably, the inserting portion is provided on the back frame, and the inserting port is provided on the chassis.

Preferably, the chassis comprises an extension portion and a mounting block, the extension portion is connected to the mounting block, and the inserting port is enclosed between the extension portion and the mounting block; and the locking block and the elastic member are arranged on the mounting block.

Preferably, a sliding groove with one end in communication with the inserting port is provided in the mounting block, the locking block is slidably arranged in the sliding groove, and the elastic member is arranged in the sliding groove.

Preferably, the elastic member comprises a spring or an elastic sheet.

Preferably, the locking block comprises an extension section; and one end of the extension section extends out of the top of the mounting block to form a stress portion, or one end of the extension section is connected to a connecting member, and the connecting member at least partially extends out of the top of the mounting block to form a stress portion.

Preferably, a front side wall of the bump is of a slope structure so as to constitute a guide surface.

The present disclosure further provides a chair, comprising a chassis and a back frame, wherein the chassis and the back frame are assembled by means of the above-mentioned quick-assembly structure.

Other advantages and effects of the present disclosure are illustrated in detail in the detailed description of the embodiments.

DETAILED DESCRIPTION OF THE EMBODIMENTS

The technical solutions in embodiments of the present disclosure will be described clearly and completely below. Obviously, the described embodiments are only part of embodiments of the present disclosure, not all of them. On the basis of the embodiments of the present disclosure, all other embodiments obtained by those of ordinary skill in the art without involving any inventive effort should fall within the scope of protection of the present disclosure.

Embodiment 1

Reference is made to FIGS. 1-4. This embodiment provides a quick-assembly structure for a chassis 2 and a back frame 1 of a chair, the quick-assembly structure being configured to quickly assemble the chassis 2 and the back frame 1.

Figure 1:
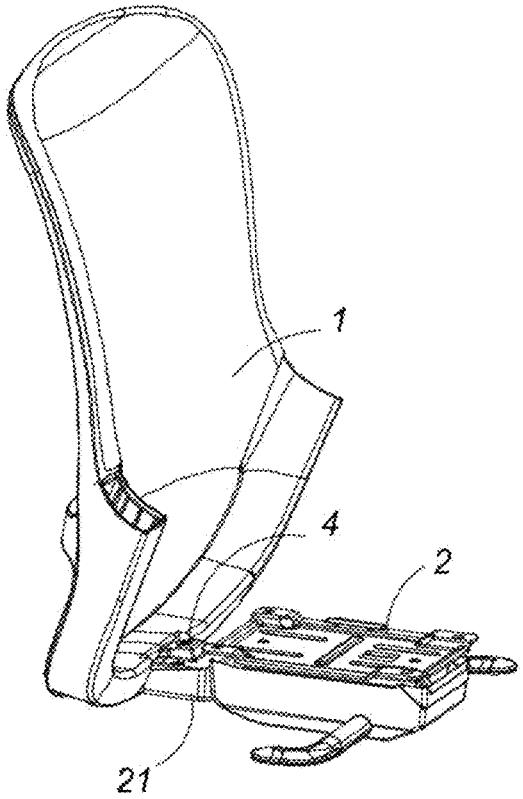
FIG. 1 is a structure diagram of a back frame and a chassis in an assembled state.
Figure 2:
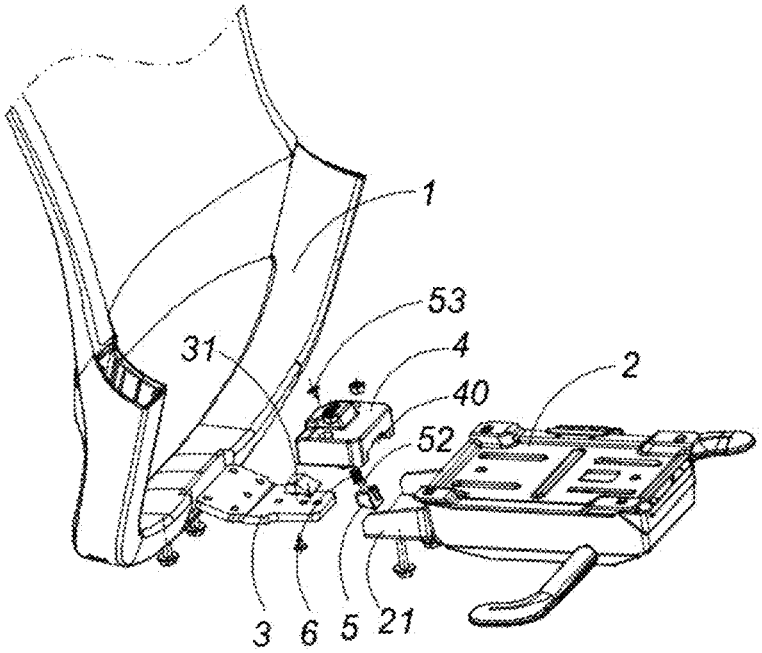
FIG. 2 is an exploded view of a junction of the back frame and the chassis.
Figure 3:
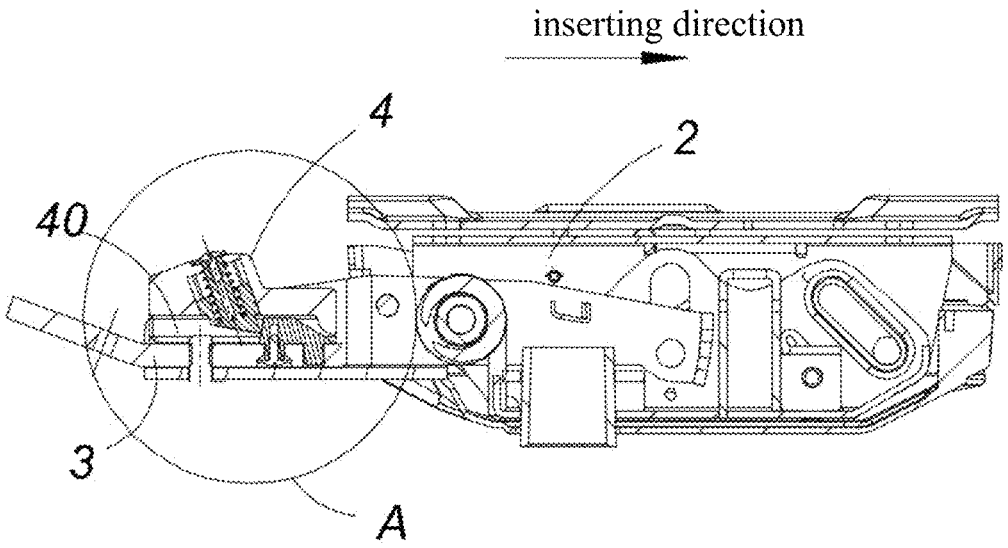
FIG. 3 is a sectional view of the back frame and the chassis in the assembled state.
Figure 4:
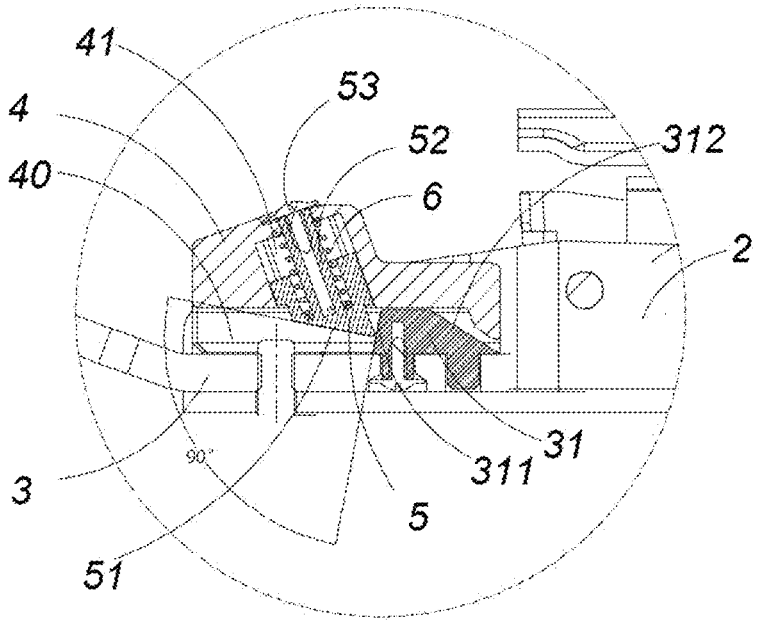
FIG. 4 is an enlarged view at A in FIG. 3.

In view of FIGS. 2-4, the quick-assembly structure comprises an inserting portion 3 and an inserting port 40 allowing the inserting portion 3 to be inserted, wherein one of the inserting portion 3 and the inserting port 40 is provided on the chassis 2, and the other one is provided on the back frame 1; and in this embodiment, the inserting portion 3 is preferably provided at the bottom of the back frame 1, and the inserting port 40 is preferably provided at the tail of the chassis 2.

As shown in FIG. 4, the inserting portion 3 is provided with a bump 31, and the bump 31 comprises an abutting surface 311; the inserting port 40 is provided with an elastic member and a locking block 5, the locking block 5 comprises a locking end, the locking block 5 is movably arranged relative to the inserting port 40, and the locking block 5 moves up and down to drive the locking end to enter and exit from the inserting port 40.

In an assembled state, the bump 31 is inserted into the inserting port 40 along with the inserting portion 3, the locking block 5 is pushed by means of an elastic force of the elastic member to enter a locking position, and at the locking position, the locking end enters the inserting port 40 and abuts against the abutting surface 311 of the bump 31 so as to restrict the inserting portion 3 from being pulled out in a direction opposite to an inserting direction thereof. It is understandable that the inserting portion 3 has a maximum insertion stroke, that is, after being inserted by the maximum stroke, the inserting portion 3 cannot be continuously inserted forwards into the inserting port 40, for example, a front end of the inserting port 40 is provided with a limiting portion for restricting the maximum insertion stroke of the inserting portion 3, or a bent angle is formed in the middle of the inserting portion 3, and the maximum insertion stroke of the inserting portion 3 is restricted by means of the bent angle.

By means of the above-mentioned configuration, during assembly, as shown in FIG. 4, the inserting portion 3 is aligned to the inserting portion 40 and is continuously inserted into the inserting portion 40, after being inserted to the maximum stroke, the inserting portion 3 cannot be continuously inserted forwards, at the same time, the locking end of the locking block 5 will automatically abut against the abutting surface 311 of the bump 31 under the action of the elastic member, thus the inserting portion 3 cannot be pulled out in an opposite direction under the abutting action of the locking end, the inserting portion 3 and the inserting portion 40 are kept fixed relative to each other, and then the back frame 1 and the chassis 2 are locked to be assembled.

It can be seen therefrom that in the solution, the back frame 1 and the chassis 2 are assembled in an inserting fit manner, compared with a traditional manner for assembly with screws fitting holes, the quick-assembly structure has the advantages as follows: firstly, the quick-assembly structure is easier and more convenient to operate; and secondly, the problem that assembly cannot be realized due to slippage of the screws or deviations of the holes can be avoided. In a word, the user experience can be improved.

In this embodiment, the specific composition of the locking end and the abutting surface 311 is as follows: as shown in FIG. 4, the locking block 5 comprises a bottom end surface 51, and a front end of the bottom end surface 51 constitutes the locking end which is of a tip structure; and a rear side surface of the bump 31 constitutes the abutting surface 311. As shown in FIG. 3, in this embodiment, the inserting port 40 extends in a horizontal direction, and the inserting direction of the inserting portion 3 and the inserting port 40 is the horizontal direction. Specifically, in the viewing angle as shown in FIG. 3, the inserting direction can be understood as a horizontal rightward direction; and accordingly, an end of each component on the left side can be understood as a rear side, and an end on the right side can be understood as a front end.

In order to prevent the phenomenon of clearance loosening due to an assembling clearance between the locking end of the locking block 5 and the abutting surface 311 after assembly of the back frame 1 and the chassis 2, in this embodiment, as shown in FIG. 4, a movement direction of the locking block 5 is inclined relative to the extension direction of the inserting port 40, in other words, the movement direction of the locking block 5 obliquely faces the abutting surface 311, so that in the assembled state, the locking end obliquely abuts against the abutting surface 311; and each of the bottom end surface 51 of the inserting portion 3 and the abutting surface 311 of the bump 31 is of a slope structure, and a plane where the bottom end surface 51 is located is perpendicular to a plane where the abutting surface 311 is located, in other words, an included angle formed by the two planes is 90° (as shown in FIG. 4).

The purpose of perpendicularly setting the plane where the bottom end surface 51 is located and the plane where the abutting surface 311 is located in this embodiment is to enable the locking block 5 to form a return dead point after the locking end abuts against the abutting surface 311 for locking, so that after the locking end of the locking block 5 abuts against the abutting surface 311, the locking block 5 can only move downwards instead of moving upwards, and at this time, the inserting portion 3 can only be inserted in a single direction and is locked in the opposite direction. In other words, the inserting portion 3 can only be inserted forwards in the inserting port 40, if the inserting portion 3 is pulled back, the locking block 5 cannot be jacked upwards by means of the abutting surface 311 due to the dead point design of the locking block 5, thus the inserting portion 3 cannot be pulled back, the phenomenon of clearance loosening can be eliminated, the assembly stability of the inserting portion 3 and the inserting port 40 can be ensured, and then the assembly stability of the back frame 1 and the chassis 2 can be ensured.

The specific composition of the inserting port 40 is as follows: in view of FIGS. 2 and 4, the chassis 2 comprises an extension portion 21 and a mounting block 4, the extension portion 21 extends at the tail of the chassis 2, the extension portion 21 is connected to the mounting block 4, and the inserting port 40 is enclosed between the extension portion 21 and the mounting block 4; and the locking block 5 and the elastic member are arranged on the mounting block 4. In this embodiment, as shown in FIG. 2, the inserting portion 3 is a steel plate and is pre-assembled on the back frame 1 to form an integral body with the back frame 1.

In order to achieve the sliding of the locking block 5 and hide the elastic member, in this embodiment, a sliding groove 41 with one end in communication with the inserting port 40 is provided in the mounting block 4, the locking block 5 is slidably arranged in the sliding groove 41, the elastic member is arranged in the sliding groove 41, and the sliding groove 41 extends obliquely to guide the sliding of the locking block 5.

As shown in FIG. 4, in this embodiment, the elastic member is a spring 6, one end thereof abuts against the locking block 5, and the other end abuts against a top wall of the sliding groove 41, such that the locking block 5 keeps the tendency of moving downwards. Of course, in other optional embodiments, the elastic member may also be an elastic structure such as an elastic sheet and the like, which is not specifically defined herein.

In order to unlock the locking block 5 to ensure that the inserting portion 3 can be pulled out of the inserting port 40, in this embodiment, as shown in FIGS. 2 and 4, the locking block 5 comprises an extension section 52, and the extension section 52 and the locking block 5 are of an integrated structure; one end of the extension section 52 is connected to a connecting member, and the connecting member at least partially extends out of the top of the mounting block 4 to form a stress portion, and the stress portion is provided so as to provide a stress point for a tool, so that during unlocking, the locking block 5 can be pulled upwards by means of the stress portion for unlocking; and the spring 6 is sleeved on the extension section 52.

In this embodiment, the connecting member is a screw 53 provided with a gasket, the screw 53 is in threaded connection at an end portion of the extension section 52, and a cap end and a gasket portion of the screw 53 are located at the top of the mounting block 4, so that when unlocking is needed, all that is required for driving the locking block 5 to move upwards for unlocking is to pull the screw 53 upwards by means of the tool.

Of course, in other optional embodiments, the stress portion may also be formed as follows: one end of the extension section 52 extends out of the top of the mounting block 4 to form the stress portion, and the unlocking operation can also be achieved in such manner.

In order to enable the locking end of the locking block 5 to relatively smoothly pass through the bump 31 to abut against the abutting surface 311 of the bump 31 when the bump 31 is inserted into the inserting port 40 along with the inserting portion 3, a front side wall of the bump 31 is of a slope structure so as to constitute a guide surface 312.

Embodiment 2

In view of FIGS. 1-4, in this embodiment, a chair is provided on the basis of Embodiment 1, the chair comprising the chassis 2 and the back frame 1, wherein the chassis 2 and the back frame 1 are assembled by means of the quick-assembly structure in Embodiment 1, and specifically, the inserting portion 3 is pre-assembled on the back frame 1, and the inserting port 40 is provided on the chassis 2.

What is claimed is:

1. A quick-assembly structure for a chassis and a back frame of a chair, the quick-assembly structure being configured to assemble the chassis and the back frame and comprising an inserting portion and an inserting port allowing the inserting portion to be inserted, wherein one of the inserting portion and the inserting port is provided on the chassis, and the other one is provided on the back frame; the inserting portion is provided with a bump, and the bump comprises an abutting surface; the inserting port is provided with an elastic member and a locking block, the locking block comprises a locking end, and the locking block is movably arranged relative to the inserting port; and in an assembled state, the bump is inserted into the inserting port along with the inserting portion, the locking block is pushed by an elastic force of the elastic member to enter a locking position, and at the locking position, the locking end enters the inserting port and abuts against the abutting surface of the bump so as to restrict the inserting portion from being pulled out in a direction opposite to an inserting direction thereof, wherein the inserting portion is provided on the back frame, and the inserting port is provided on the chassis, wherein the chassis comprises an extension portion and a mounting block, the extension portion is connected to the mounting block, and the inserting port is enclosed between the extension portion and the mounting block, and the locking block and the elastic member are arranged on the mounting block, wherein a sliding groove with one end in communication with the inserting port is provided in the mounting block, the locking block is slidably arranged in the sliding groove, and the elastic member is arranged in the sliding groove.

2. The quick-assembly structure according to claim 1, wherein the locking block comprises a bottom end surface, and a front end of the bottom end surface constitutes the locking end; and a rear side surface of the bump constitutes the abutting surface.

3. The quick-assembly structure according to claim 2, wherein a movement direction of the locking block is inclined relative to an extension direction of the inserting port, each of the bottom end surface of the inserting portion and the abutting surface of the bump is of a slope structure, and a plane where the bottom end surface is located is perpendicular to a plane where the abutting surface is located.

4. The quick-assembly structure according to claim 1, wherein the elastic member comprises a spring or an elastic sheet.

5. The quick-assembly structure according to claim 1, wherein the locking block comprises an extension section; and one end of the extension section extends out of a top of the mounting block to form a stress portion, or one end of the extension section is connected to a connecting member, and the connecting member at least partially extends out of the top of the mounting block to form a stress portion.

6. The quick-assembly structure according to claim 3, wherein a front side wall of the bump is of a slope structure so as to constitute a guide surface.

7. A chair, comprising a chassis and a back frame, wherein the chassis and the back frame are assembled by the quick-assembly structure according to claim 1.

* * * * *